US009378914B2

(12) United States Patent
Isozaki et al.

(10) Patent No.: US 9,378,914 B2
(45) Date of Patent: Jun. 28, 2016

(54) CONTACT DEVICE AND ELECTROMAGNETIC CONTACTOR USING THE SAME

(71) Applicants: FUJI ELECTRIC CO., LTD., Kawasaki-shi (JP); FUJI ELECTRIC FA COMPONENTS&SYSTEMS CO., LTD., Chuo-ku, Tokyo (JP)

(72) Inventors: Masaru Isozaki, Ichihara (JP); Osamu Kashimura, Hino (JP); Hiroyuki Tachikawa, Yokohama (JP); Kouetsu Takaya, Kounosu (JP); Yasuhiro Naka, Kounosu (JP); Yuji Shiba, Kounosu (JP)

(73) Assignees: FUJI ELECTRIC CO., LTD., Kawasaki-Shi (JP); FUJI ELECTRIC FA COMPONENTS & SYSTEMS CO., LTD., Tokyo (JP)

( * ) Notice: Subject to any disclaimer, the term of this patent is extended or adjusted under 35 U.S.C. 154(b) by 0 days.

(21) Appl. No.: 14/344,821

(22) PCT Filed: Oct. 3, 2012

(86) PCT No.: PCT/JP2012/006358

§ 371 (c)(1),
(2) Date: Mar. 13, 2014

(87) PCT Pub. No.: WO2013/051263

PCT Pub. Date: Apr. 11, 2013

(65) Prior Publication Data

US 2015/0048908 A1 Feb. 19, 2015

(30) Foreign Application Priority Data

Oct. 7, 2011 (JP) ..... 2011-223145

(51) Int. Cl.
*H01H 75/00* (2006.01)
*H01H 50/54* (2006.01)
(Continued)

(52) U.S. Cl.
CPC ..... *H01H 50/54* (2013.01); *H01H 1/54* (2013.01); *H01H 9/443* (2013.01); *H01H 50/546* (2013.01);
(Continued)

(58) Field of Classification Search
CPC ..... H01H 1/06; H01H 1/58; H01H 1/54; H01H 1/20; H01H 50/54; H01H 50/641; H01H 50/00; H01H 50/546; H01H 71/10; H01H 3/222; H01H 77/101; H01H 31/24
USPC ..... 335/6
See application file for complete search history.

(56) References Cited

U.S. PATENT DOCUMENTS 2,929,899 A 3/1960 Filliette
3,419,828 A 12/1968 Bremer
(Continued)

FOREIGN PATENT DOCUMENTS

CN 1969355 A 5/2007
CN 101101833 A 1/2008
(Continued)

OTHER PUBLICATIONS

PCT/ISA/210, "International Search Report for International Application No. PCT/JP2012/006358".
(Continued)

*Primary Examiner* — Shawki S Ismail
*Assistant Examiner* — Lisa Homza
(74) *Attorney, Agent, or Firm* — Manabu Kanesaka

(57) ABSTRACT

A contact device includes a contact mechanism including a pair of fixed contacts disposed to maintain a predetermined distance and a movable contact disposed to be capable of contacting to and separating from the pair of fixed contacts. The movable contact has a conductive plate portion extending in a direction crossing a moving direction of the movable contact in a contact housing case. Each of the pair of fixed contacts includes an inner side conductor plate portion having one end and the other end portion extending toward the outside of the contact housing case in parallel to the conductive plate portion, and an outer side conductor plate portion connected to the other end portion of the inner side conductor plate portion and extending in a direction separating from the movable contact, to form an L-shaped conductor portion to generate a Lorentz force opposing an electromagnetic repulsion force.

2 Claims, 4 Drawing Sheets

(51) Int. Cl.

| | |
|---|---|
| ***H01H 1/54*** | (2006.01) |
| ***H01H 9/44*** | (2006.01) |
| ***H01H 51/22*** | (2006.01) |
| ***H01H 50/64*** | (2006.01) |
| ***H01H 71/10*** | (2006.01) |
| *H01H 51/28* | (2006.01) |
| *H01H 50/02* | (2006.01) |

(52) U.S. Cl.

CPC ..... *H01H 50/641* (2013.01); *H01H 51/2209* (2013.01); *H01H 71/10* (2013.01); *H01H 51/284* (2013.01); *H01H 2050/025* (2013.01)

(56) References Cited

U.S. PATENT DOCUMENTS

| | | | | |
|---|---|---|---|---|
| 3,436,697 | A * | 4/1969 | Snyder | 335/115 |
| 3,651,437 | A * | 3/1972 | Kiyoshi | 335/131 |
| 5,475,193 | A * | 12/1995 | Perdoncin | 218/34 |
| 5,495,220 | A * | 2/1996 | Takaya et al. | 335/274 |
| 5,546,061 | A * | 8/1996 | Okabayashi et al. | 335/78 |
| 5,892,194 | A * | 4/1999 | Uotome et al. | 218/68 |
| 6,111,488 | A * | 8/2000 | Nakamura et al. | 335/132 |
| 6,411,184 | B1 * | 6/2002 | Comtois et al. | 335/106 |
| 6,700,466 | B1 * | 3/2004 | Yamamoto et al. | 335/132 |
| 6,703,575 | B1 * | 3/2004 | Yamamoto | 218/46 |
| 7,915,985 | B2 * | 3/2011 | Schmitz et al. | 335/201 |
| 8,138,863 | B2 * | 3/2012 | Tanaka et al. | 335/195 |
| 8,179,217 | B2 * | 5/2012 | Kawaguchi et al. | 335/80 |
| 2002/0135447 | A1 * | 9/2002 | Gruner | 335/132 |
| 2004/0066261 | A1 | 4/2004 | Takeshi et al. | |
| 2005/0148216 | A1 | 7/2005 | Takeshi et al. | |
| 2007/0241847 | A1 | 10/2007 | Yamamoto et al. | |
| 2009/0315653 | A1 * | 12/2009 | Suzuki et al. | 335/185 |
| 2009/0322454 | A1 | 12/2009 | Tanaka et al. | |
| 2012/0326815 | A1 * | 12/2012 | Suzuki et al. | 335/185 |
| 2013/0113580 | A1 * | 5/2013 | Naka et al. | 335/196 |
| 2013/0115829 | A1 * | 5/2013 | Naka et al. | 439/883 |
| 2013/0127571 | A1 * | 5/2013 | Takaya et al. | 335/201 |
| 2013/0229247 | A1 * | 9/2013 | Tachikawa et al. | 335/196 |
| 2013/0229248 | A1 * | 9/2013 | Yokoyama et al. | 335/201 |
| 2013/0335175 | A1 * | 12/2013 | Tachikawa et al. | 335/147 |
| 2014/0062627 | A1 * | 3/2014 | Naka et al. | 335/189 |
| 2015/0002250 | A1 * | 1/2015 | Kashimura et al. | 335/204 |
| 2015/0048908 | A1 * | 2/2015 | Isozaki et al. | 335/6 |

FOREIGN PATENT DOCUMENTS

| | | | |
|---|---|---|---|
| FR | 1446838 | A | 7/1966 |
| GB | 787072 | A | 12/1957 |
| JP | 2001-118450 | A | 4/2001 |
| JP | 2001-210170 | A | 8/2001 |
| JP | 2006-310251 | A | 11/2006 |

OTHER PUBLICATIONS

Europe Patent Office, "Search Report for EP 12838528.3," Jun. 10, 2015.

China Patent Office, "Office Action for CN 201280049701.3," Jun. 18, 2015.

* cited by examiner

CONTACT DEVICE AND ELECTROMAGNETIC CONTACTOR USING THE SAME

RELATED APPLICATIONS

The present application is National Phase of International Application No. PCT/JP2012/006358 filed Oct. 3, 2012, and claims priority from Japanese Application No. 2011-223145 filed Oct. 7, 2011.

TECHNICAL FIELD

The present invention relates to a contact device including fixed contacts interposed in a current path and a movable contact, and to an electromagnetic contactor using the contact device, which is arranged to generate Lorentz forces opposing electromagnetic repulsion forces causing the movable contact to separate from the fixed contacts when current is conducted.

BACKGROUND ART

As a contact mechanism which carries out the opening/closing of a current path, there has heretofore been proposed a switch of, for example, a configuration wherein a fixed contact applied to a switch, such as a circuit breaker, a current limiter, or an electromagnetic contactor, wherein an arc is generated in a receptacle when current is interrupted, is bent in a U-shape in side view, a fixed contact point is formed in a bend portion, and a movable contact point of a movable contact is disposed so as to be capable of contacting to and separating from the fixed contact point. The switch is arranged so that an opening speed is enhanced by increasing an electromagnetic repulsion force acting on the movable contact when a large current is interrupted; thus, rapidly extending an arc (for example refer to PTL1).

CITATION LIST

Patent Literature

PTL 1: JP-A-2001-210170

SUMMARY OF INVENTION

Technical Problem

Meanwhile, the heretofore known example described in the PTL 1 is arranged such that the fixed contact is formed in the U-shape in side view, thus increasing an electromagnetic repulsion force to be generated. Because of this increased electromagnetic repulsion force, it is possible to enhance the opening speed of the movable contact when a large current is interrupted due to a short circuit or the like, rapidly extend the arc, and limit a fault current to a small value. However, with an electromagnetic contactor using a large current, it is necessary to prevent a movable contact from opening due to electromagnetic repulsion forces when the large current is conducted. Because of this, the heretofore known example described in the PTL 1 cannot be applied, and in general, this is dealt with by increasing the spring force of a contact spring securing the contact pressure at which the movable contact contacts the fixed contacts.

When the contact pressure generated by the contact spring is increased in this way, it is also necessary to increase the thrust generated by an electromagnet which drives the movable contact, and there is an unsolved problem of an increase in the size of the overall configuration.

Therefore, the invention, having been contrived on the heretofore described unsolved problem of the heretofore known example, has an object of providing a contact device with which it is possible to suppress electromagnetic repulsion forces causing a movable contact to open when current is conducted without increasing the size of the overall configuration, and an electromagnetic contactor using the contact device.

Solution to Problem

In order to achieve the object, a first aspect of a contact device according to the invention includes a contact mechanism including a pair of fixed contacts disposed maintaining a predetermined distance and a movable contact disposed so as to be capable of contacting to and separating from the pair of fixed contacts. The movable contact has a conductive plate portion extending in a direction crossing a moving direction of the movable contact in a contact housing case. Each of the pair of fixed contacts includes an inner side conductor plate portion and an outer side conductor plate portion to form an L-shaped conductor portion generating a Lorentz force opposing an electromagnetic repulsion force generated in an opening direction between the fixed contact and movable contact when current is conducted. The inner side conductor plate portion has one end thereof opposite to one end portion of the conductive plate portion of the movable contact, and the other end portion thereof extending toward the outside of the contact housing case in parallel to the conductive plate portion. Also, the outer side conductor plate portion is connected to the other end portion of the inner side conductor plate portion outside the contact housing case, and at least extending in a direction separating from the movable contact.

According to this configuration, as the fixed contacts are formed in a shape, for example, an L-shape or a U-shape, such as to generate Lorentz forces opposing electromagnetic repulsion forces generated in the opening direction between the fixed contacts and movable contact when current is conducted, it is possible to prevent the movable contact from opening when a large current is conducted. Moreover, because only the inner side conductor plate portions of the fixed contacts and the movable contact exist, and no other conductor portion exists, in the contact housing case, it is possible to stabilize the generation of arcs when the current is interrupted.

Also, a second aspect of the contact device according to the invention is such that the outer side conductor plate portion includes a side plate portion connected to the inner side conductor plate portion and extending toward a top plate portion of the contact housing case, and a fixed plate portion extending along the outer surface of the top plate portion of the contact housing case from the side plate portion, to form in an L-shape, and the fixed plate portion being connected to a connection terminal.

According to this configuration, the L-shape is formed by connecting the fixed conductor plate portion to the outer side conductor plate portion of each fixed contact, it is also possible to generate Lorentz forces between fixed conductor plate portions and the current flowing through the movable contact opposite to the fixed conductor plate portions across the contact housing case.

Also, a third aspect of the contact device according to the invention is such that the contact housing case is formed of an insulating material.

According to this configuration, as the contact housing case is formed of an insulating material, it is not necessary to take into account the insulation of the outer side conductor plate portions and fixed conductor plate portions of the fixed contacts.

Also, a fourth aspect of the contact device according to the invention is such that the contact housing case encloses a shielding gas.

According to this configuration, as a shielding gas is enclosed in the contact housing case, it is possible to efficiently extinguish arcs generated when the current is interrupted.

Also, an electromagnetic contactor according to one aspect of the invention includes the contact device according to any one of the first to fourth aspects, wherein the movable contact is connected to a movable iron core of an operating electromagnet.

According to this configuration, it is possible to reduce the spring force of a contact spring which brings the movable contact into contact with the fixed contacts by generating Lorentz forces opposing electromagnetic repulsion forces causing the contacts between the movable contact and fixed contacts to open when current is conducted through the electromagnetic contactor. Accordingly, it is also possible to reduce the thrust of an electromagnet which drives the movable contact, and thus possible to provide a small electromagnetic contactor.

Advantageous Effects of Invention

According to the invention, in the contact mechanism having the fixed contacts interposed in a current conduction path and the movable contact, it is possible to generate Lorentz forces opposing electromagnetic repulsion forces generated in an opening direction between the fixed contacts and movable contact when a large current is conducted. Because of this, it is possible to reliably prevent the movable contact from opening when the large current is conducted without using a mechanical pressing force.

DESCRIPTION OF EMBODIMENTS

Hereafter, a description will be given, based on the drawings, of embodiments of the invention.

Figure 1:
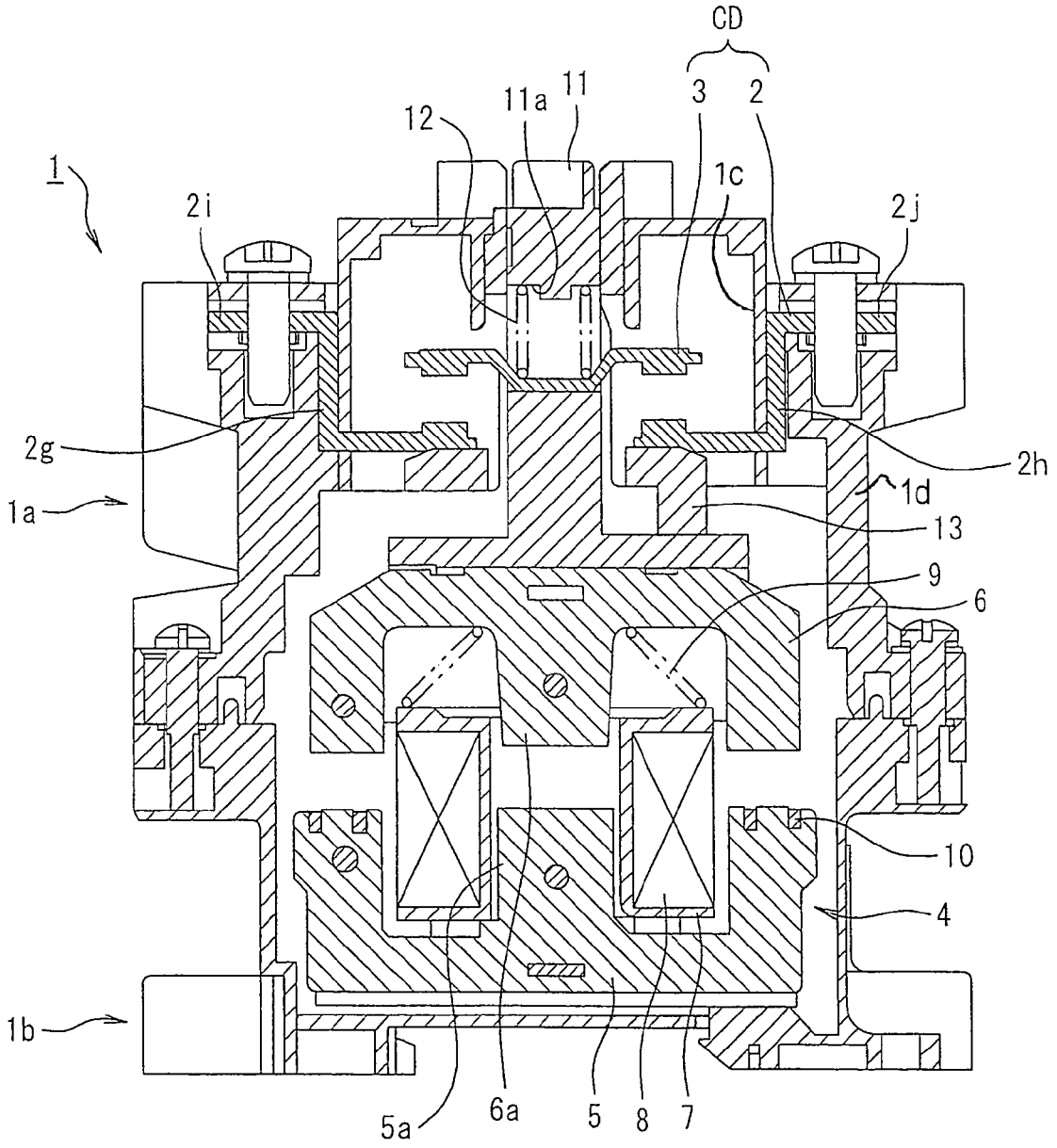
FIG. 1 is a sectional view showing a first embodiment when the invention is applied to an electromagnetic contactor.

FIG. 1 is a sectional view showing one embodiment when a contact device according to the invention is applied to an electromagnetic contactor.

In FIG. 1, reference 1 is a main body case made of, for example, synthetic resin. The main body case 1 has a dual-partitioning structure formed of an upper case 1*a* acting as a contact housing case and a lower case 1*b*. A contact device CD is installed in the upper case 1*a*. The contact device CD includes a pair of fixed contacts 2 fixed to the upper case 1*a* and a movable contact 3 disposed so as to be capable of contacting to and separating from the fixed contacts 2.

Also, an operating electromagnet 4 which drives the movable contact 3 is disposed in the lower case 1*b*. The operating electromagnet 4 is such that a fixed iron core 5 formed of an E-shaped leg type laminated steel plate and a movable iron core 6 similarly formed of an E-shaped leg type laminated steel plate are disposed opposite to each other.

An electromagnetic coil 8, wound in a coil holder 7, which is supplied with a single-phase alternating current is fixed to a central leg portion 5*a* of the fixed iron core 5. Also, a return spring 9 which urges the movable iron core 6 in a direction away from the fixed iron core 5 is disposed between the upper surface of the coil holder 7 and the root of a central leg 6*a* of the movable iron core 6.

Furthermore, a shading coil 10 is embedded in the upper end face of the outer side leg portion of the fixed iron core 5. It is possible, due to the shading coil 10, to suppress variations in electromagnetic attractive force, noise, and vibration caused by a change in alternating flux in a single-phase alternating current electromagnet.

Further, a contact holder 11 is connected to the upper end of the movable iron core 6. The movable contact 3 is held, in an insertion hole 11*a* formed on the upper end side of the contact holder 11 in a direction perpendicular to the axis, by being pressed downward against the fixed contacts 2 by a contact spring 12 so as to obtain a predetermined contact pressure.

Figure 2A:
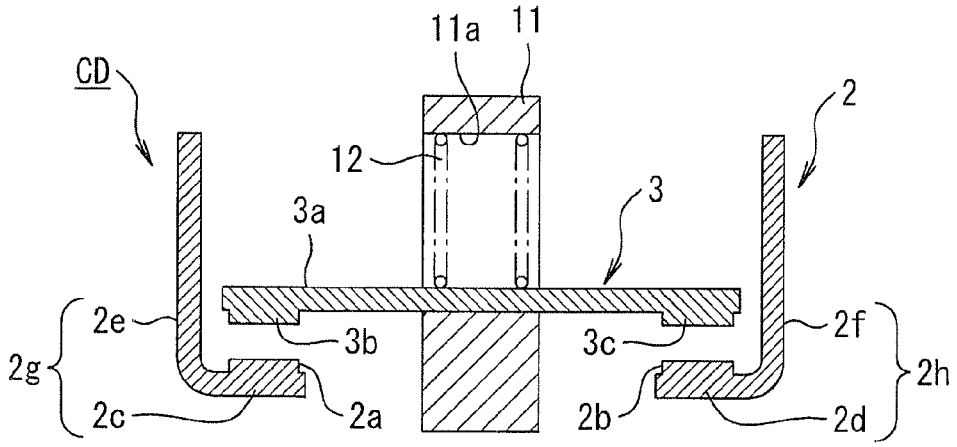
FIGS. 2(*a*)-2(*c*) are diagrams showing one embodiment of a contact device of the invention, wherein FIG. 2(*a*) is a sectional view showing the contact device when current is interrupted, FIG. 2(*b*) is a sectional view showing the contact device when current is conducted, and FIG. 2(*c*) is a sectional view showing magnetic fluxes when current is conducted.
Figure 2B:
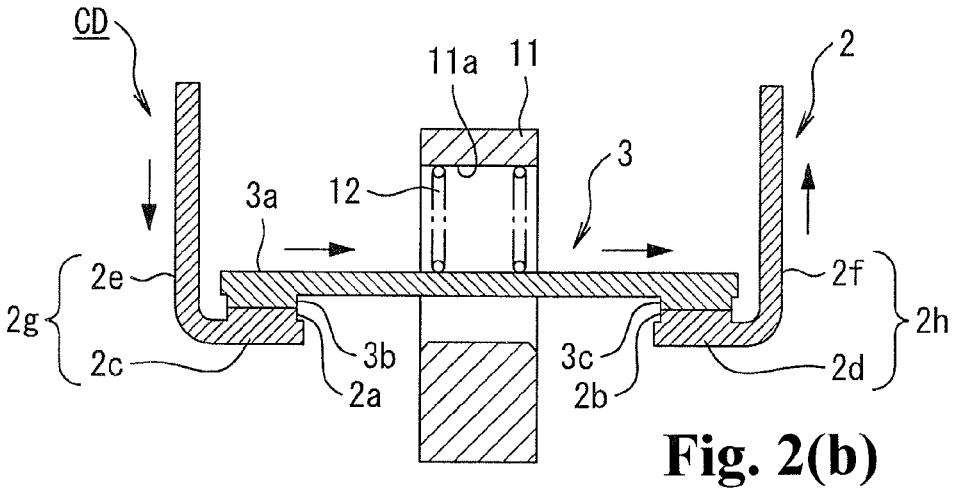
Figure 2C:
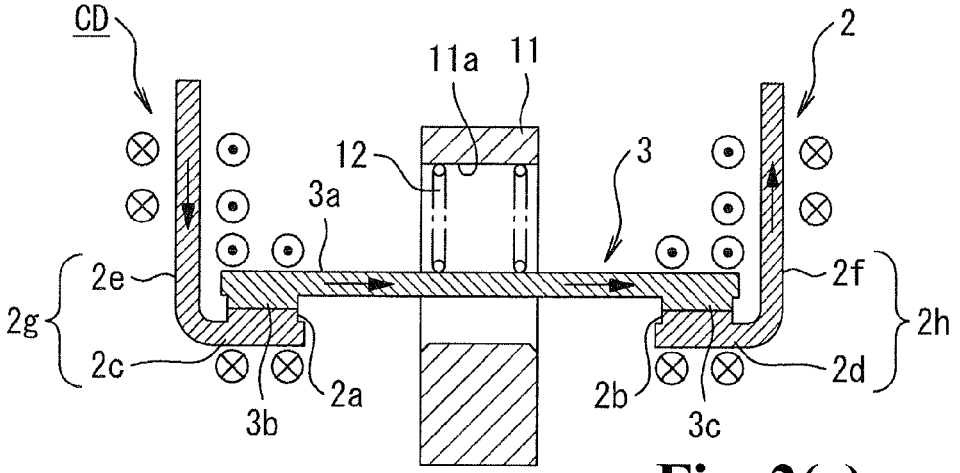

As shown in enlarged dimension in FIGS. 2(*a*)-2(*c*), the movable contact 3 is such that the central portion thereof is configured of an elongated plate-shaped conductive plate portion 3*a* extending in a direction perpendicular to a direction in which the movable contact 3 is movable by being pressed by the contact spring 12, and movable contact portions 3*b* and 3*c* are formed one on each end side lower surface of the conductive plate portion 3*a*.

Meanwhile, as shown in enlarged dimension in FIGS. 2(*a*)-2(*c*), each of the fixed contacts 2 includes an L-shaped conductive plate portion 2*g*, 2*h* which is formed of an inner side conductor plate portion 2*c*, 2*d*, one end of which supports the corresponding one of a pair of fixed contact portions 2*a* and 2*b* facing the movable contact portion 3*b* of the movable contact 3 from below, and the other end of which is directed outward parallel to the conductive plate portion 3*a* and extends toward the outer side of an inner portion 1*c* of the upper case 1*a*, and an outer side conductor plate portion 2*e*, 2*f* extending upward along the inner portion 1*c* of the upper case 1*a* from the other end of the inner side conductor plate portion 2*c*, 2*d* which is on the outer side of the inner portion 1*c* of the upper case 1*a*, that is, extending in the direction in which the movable contact 3 moves away. Further, external connection terminals 2*i* and 2*j* extending outward in left and right directions are connected respectively to the respective upper ends of the L-shaped conductive plate portions 2*g* and 2*h* located on an outer portion 1*d* of the upper case 1*a*, as shown in FIG. 1.

Next, a description will be given of an operation of the heretofore described embodiment.

For now, in a condition in which the electromagnetic coil 8 of the operating electromagnet 4 is in a non-energized state, no electromagnetic attractive force is generated between the fixed iron core 5 and movable iron core 6, the movable iron core 6 is urged by the return spring 9 in a direction in which the movable iron core 6 separates upward from the fixed iron core 5, and the upper end of the movable iron core 6 is held in a current interruption position by abutting against a stopper 13.

In a condition in which the movable iron core 6 is in the current interruption position, the movable contact 3 contacts the bottom portion of the insertion hole 11*a* of the contact holder 11 by the contact spring 12, as shown in FIG. 2(*a*). In this condition, the movable contact portions 3*b* and 3*c* formed one on each end side of the conductive plate portion 3*a* of the movable contact 3 are separated upward from the fixed contact portions 2*a* and 2*b* of the fixed contact 2, and the contact device CD is in a current interruption condition.

When a single-phase alternating current is supplied to the electromagnetic coil 8 of the operating electromagnet 4 in the current interruption condition of the contact device CD, an attractive force is generated in the fixed iron core 5, and the movable iron core 6 is attracted downward against the urging force of the contact spring 12. Because of this, the movable contact 3 supported by the contact holder 11 descends, the movable contact portions 3*b* and 3*c* contact the fixed contact portions 2*a* and 2*b* of the fixed contact 2 due to the contact pressure of the contact spring 12, and a current conduction path is formed, thus attaining a current conduction condition (FIG. 2(*b*)).

When the current conduction condition is attained, a large current in the order of, for example, several hundred to one thousand several hundred amperes input from, for example, the external connection terminal 2*i* of the fixed contact 2 connected to a direct current power supply (not shown) is supplied to the movable contact portion 3*b* of the movable contact 3 through the outer side conductor plate portion 2*e*, inner side conductor plate portion 2*c*, and fixed contact portion 2*a*. The large current supplied to the movable contact portion 3*h* is supplied to the fixed contact portion 2*b* through the conductive plate portion 3*a* and movable contact portion 3*c*. The large current supplied to the fixed contact portion 2*b* is supplied to the inner side conductor plate portion 2*d*, outer side conductor plate portion 2*f*, and external connection terminal 2*j*, and a current conduction path through which the current is supplied to an external load is formed.

At this time, electromagnetic repulsion forces which cause the movable contact portions 3*b* and 3*c* to open are generated between the fixed contact portions 2*a* and 2*b* of the fixed contacts 2 and the movable contact portions 3*b* and 3*c* of the movable contact 3.

However, the fixed contacts 2 are such that as the L-shaped conductive plate portions 2*g* and 2*h* are formed by the inner side conductor plate portions 2*c* and 2*d* and outer side conductor plate portions 2*e* and 2*f*, as shown in FIGS. 2(*a*)-2(*c*), by the heretofore described current path being formed, magnetic fluxes generated by the current flowing through the outer conductor plate portions 2*e* and 2*f* are added to the magnetic flux on the upper side of the movable contact 3, thus increasing the magnetic flux density, compared with when only the movable contact 3 exists. Because of this, Lorentz forces which cause the movable contact portions 3*b* and 3*c* to be pressed toward the fixed contact portions 2*a* and 2*b* sides against the opening direction electromagnetic repulsion forces can be caused to act on the conductive plate portion 3*a* of the movable contact 3 in accordance with Fleming's left-hand rule.

Consequently, even when electromagnetic repulsion forces are generated in a direction such as to cause the movable contact 3 to open, it is possible to generate Lorentz forces opposing the electromagnetic repulsion forces, meaning that it is possible to reliably prevent the movable contact 3 from opening. Because of this, it is possible to reduce the pressing force of the contact spring 12 supporting the movable contact 3, as a result of which it is also possible to reduce thrust generated in the operating electromagnet 4, and it is thus possible to reduce the size of the overall configuration.

Moreover, in this case, it being sufficient to simply form the L-shaped conductive plate portions 2*q* and 2*h* in the fixed contacts 2 or form the external connection terminals 2*i* and 2*j* additionally on the L-shaped conductive plate portions 2*g* and 2*h*, it is possible to easily carry out the processing of the fixed contacts 2, and there is no need for a separate member which generates an electromagnetic force or mechanical force opposing the opening direction electromagnetic repulsion forces, meaning that the number of parts do not increase, and it is thus possible to suppress an increase in the size of the overall configuration.

Furthermore, in the upper case 1*a*, the movable contact 3 is directly facing the inner side conductor plate portions 2*c* and 2*d* of the fixed contacts 2, and is facing the outer side conductor portions 2*e* and 2*f* of the fixed contacts 2 across the side surface plate of the upper case 1*a*. Because of this, as no conductor plate portion exists in a direction in which the movable contact 3 moves away from the inner side conductor plate portions 2*c* and 2*d* of the fixed contacts 2, arcs generated when the current is interrupted are generated only between the inner side conductor plate portions 2*c* and 2*d* of the fixed contacts 2 and the conductor plate portion 3*a* of the movable contact 3, meaning that there is no need to provide an arc barrier such as an insulator cover for preventing unexpected arc generation, and it is thus possible to more simplify the configuration of the contact device CD.

Next, a description will be given, referring to FIG. 3, of a second embodiment of the invention.

The second embodiment is configured to reduce the size of the electromagnetic contactor itself.

Figure 3:
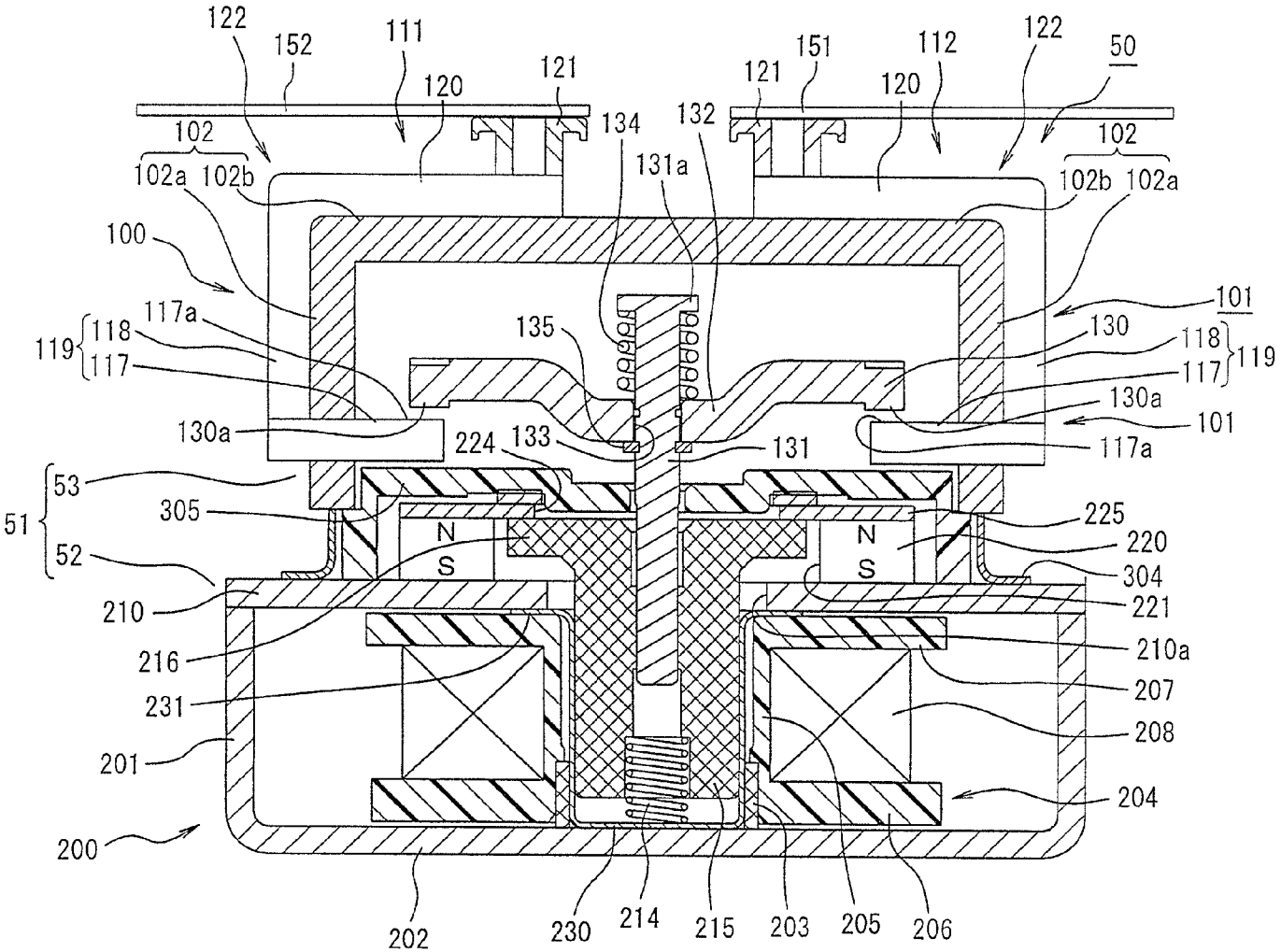
FIG. 3 is a sectional view showing a second embodiment of the invention.

That is, in the second embodiment, the electromagnetic contactor is configured as shown in FIG. 3. In FIG. 3, reference 50 is an electromagnetic contactor, and the electromagnetic contactor 50 has an exterior insulation container 51 made of, for example, synthetic resin.

The exterior insulation container 51 is configured of a lower case 52 configured of a bottomed cylindrical body whose upper end face is opened and an upper case 53 configured of a bottomed cylindrical body, mounted on the upper end face of the lower case 52, whose lower end portion is opened.

A contact device 100 disposed with a contact mechanism and an electromagnet unit 200 which drives the contact device 100 are housed in the exterior insulating container 51 in such a way that the electromagnet unit 200 is disposed on the bottom plate of the lower case 52.

Figure 4:
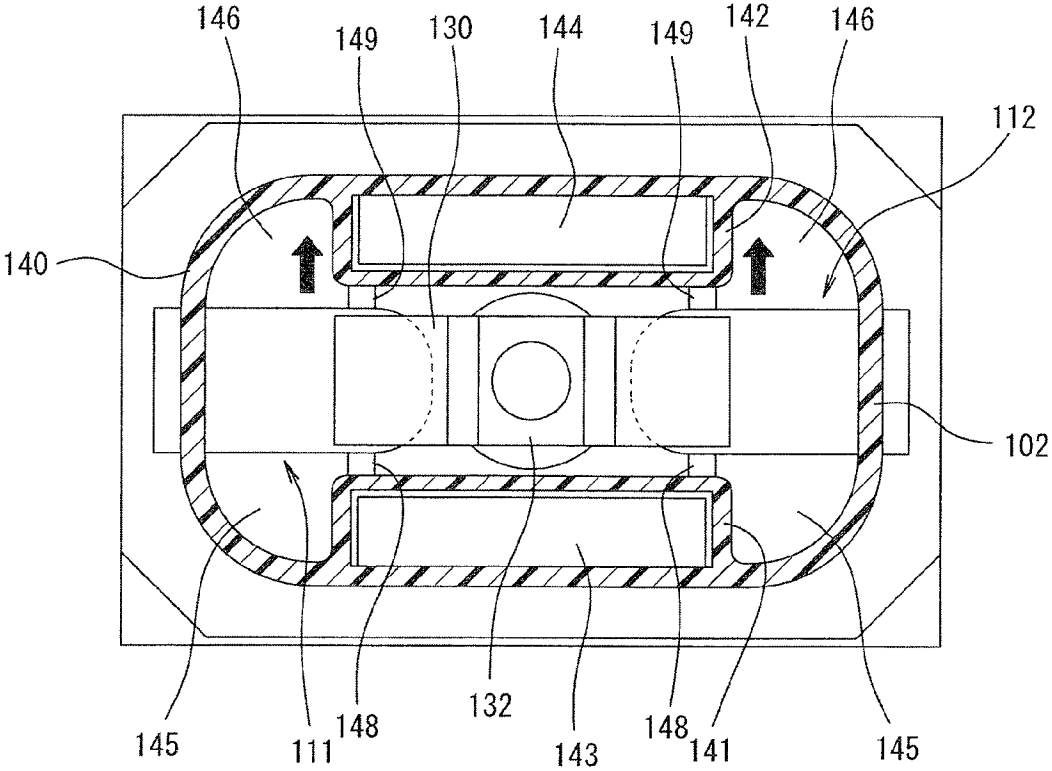
FIG. 4 is a plan view when a top plate portion of a contact housing case of FIG. 3 is removed.

The contact device 100 has a contact housing case 102 which houses a contact mechanism 101, as also shown in to FIG. 4. The contact housing case 102 is formed into a tub-shaped body by integrally molding a rectangular cylindrical portion 102*a* and a top plate portion 102*b* closing the upper end of the rectangular cylindrical portion 102*a* from, for example, ceramic or synthetic resin. A metal foil is formed on the open end face side of the tub-shaped body by a metalizing process, and a metal connecting member 304 is seal joined to the metal foil, thus configuring the contact housing case 102. Further, the connecting member 304 of the contact housing case 102 is seal joined to an upper magnetic yoke 210 to be described hereafter.

The contact mechanism 101 includes a pair of fixed contacts 111 and 112 disposed fixed to their respective left and right side plate portions of the contact housing case 102 and a movable contact 130 disposed so as to be capable of contacting, from above, and separating from the fixed contacts 111 and 112.

Each of the pair of fixed contacts 111 and 112 is such that an L-shaped conductor portion 119 is formed of an inner side conductor plate portion 117 fixed passing through the corresponding one of the left and right side plate portions of the rectangular cylindrical portion 102*a* of the contact housing case 102 and an outer side conductor plate portion 118 connected to an end portion of the inner side conductor plate portion 117 on the outer peripheral surface side of the contact housing case 102 and at least extending in a direction in which the movable contact moves away.

Further, the upper end portion of the outer side conductor plate portion 118 of the L-shaped conductor portion 119 is extended to the top plate portion 102*b* of the contact housing case 102, and the upper end of the outer side conductor plate portion 118 is bent along the top plate portion 102*b*, thus forming a fixed conductor portion 120 opposite to the movable contact 130. An external connection terminal 121 is formed at the inner side end of the fixed conductor portion 120.

Consequently, the pair of fixed contacts 111 and 112 is configured in a C-shape such that the extended end portion of the movable contact 130 is enclosed by the L-shaped conductor portion 119 and the fixed conductor portion 120 connected to the upper end of the outer side conductor plate portion 118.

Herein, the inner side conductor plate portion 117 and outer side conductor plate portion 118 are fixed by, for example, brazing. The inner side conductor plate portion 117 and outer side conductor plate portion 118 may be fixed, not only by brazing, but by welding.

Further, contact portions 117*a* wherein the inner side end portions of the inner side conductor plate portions 117 of the fixed contacts 111 and 112 face the movable contact 130 extension direction end portions from below are formed.

Further, the movable contact 130 is disposed so as to face the contact portions 117*a* of the fixed contacts 111 and 112 from above. The movable contact 130 is formed of a conductive plate portion extending in a direction crossing a direction in which the movable contact 130 is movable. The movable contact 130 is supported by a connecting shaft 131 fixed in a movable plunger 215 of the electromagnet unit 200, to be described hereafter. The movable contact 130 is such that a central portion thereof in the vicinity of the connecting shaft 131 protrudes downward, whereby a depressed portion 132 is formed, and a through hole 133 into which to insert the connecting shaft 131 is formed in the depressed portion 132.

A flange portion 131*a* protruding outward is formed at the upper end of the connecting shaft 131. The connecting shaft 131 is inserted from the lower end side thereof into a contact spring 134, and then inserted into the through hole 133 of the movable contact 130, thus abutting the upper end of the contact spring 134 against the flange portion 131*a*, and the movable contact 130 is positioned using, for example, a C-ring 135 so as to obtain a predetermined urging force from the contact spring 134.

The movable contact 130, in a released condition, takes on a condition in which the contact portions at either end thereof and the contact portions 117*a* of the inner side conductor plate portions 117 of the L-shaped conductor portions 119 of the fixed contacts 111 and 112 are out of contact with each other while maintaining a predetermined interval. Also, the movable contact 130 is set so that, in a closed position, the contact portions at either end thereof contact the contact portions 117*a* of the inner side conductor plate portions 117 of the L-shaped conductor portions 119 of the fixed contacts 111 and 112 at a predetermined contact pressure applied by the contact spring 134.

Furthermore, magnet housing cylindrical bodies 141 and 142 are formed one in each of positions on the contact housing case 102 inner peripheral surfaces opposite to their respective side surfaces of the movable contact 130, as shown in FIG. 4. Arc extinguishing permanent magnets 143 and 144 are inserted and fixed in the magnet housing cylindrical bodies 141 and 142 respectively.

The arc extinguishing permanent magnets 143 and 144 are magnetized in a thickness direction so that the mutually opposing magnetic pole faces thereof are N-poles. Also, the arc extinguishing permanent magnets 143 and 144 are set so that both left-right direction end portions thereof are slightly inward of positions in which are opposed the contact portions 117*a* of the fixed contacts 111 and 112 and the contact portions 130*a* of the movable contact 130, as shown in FIG. 4. Further, two pairs of arc extinguishing spaces 145 and 146 are formed one pair on the left-right direction outer sides of each respective magnet housing cylindrical body 141 and 142.

Also, movable contact guide members 148 and 149 which limit turning of the movable contact 130 by slide contacting side edges of the magnet housing cylindrical bodies 141 and 142 toward either end of the movable contact 130, are formed protruding.

By disposing the arc extinguishing permanent magnets 143 and 144 on the inner peripheral surface side of the insulating cylindrical body 140 in this way, it is possible to bring the arc extinguishing permanent magnets 143 and 144 near to the movable contact 130. Because of this, magnetic fluxes $\phi$ emanating from the N-pole sides of the two arc extinguishing permanent magnets 143 and 144 cross portions in which are opposed the contact portions 117*a* of the fixed contacts 111 and 112 and the contact portions 130*a* of the movable contact 130, from the inner side to the outer side in a left-right direction, with a high flux density.

The electromagnet unit 200, as shown in FIG. 3, has a magnetic yoke 201 of a flattened U-shape in side view, and a cylindrical auxiliary yoke 203 is fixed to the central portion of a bottom plate portion 202 of the magnetic yoke 201. A spool 204 is disposed on the outer side of the cylindrical auxiliary yoke 203.

The spool 204 is configured of a central cylindrical portion 205 in which the cylindrical auxiliary yoke 203 is inserted, a lower flange portion 206 protruding radially outward from the lower end portion of the central cylindrical portion 205, and an upper flange portion 207 protruding radially outward from slightly below the upper end of the central cylindrical portion 205. Further, an exciting coil 208 is wound in a housing space configured of the central cylindrical portion 205, lower flange portion 206, and upper flange portion 207.

Further, an upper magnetic yoke 210 is fixed between the upper ends forming the open end of the magnetic yoke 201. A through hole 210*a* opposite to the central cylindrical portion 205 of the spool 204 is formed in the central portion of the upper magnetic yoke 210.

Further, the movable plunger 215, in which is disposed a return spring 214 between a bottom portion of the movable plunger 215 and the bottom plate portion 202 of the magnetic yoke 201, is disposed in the central cylindrical portion 205 of the spool 204 so as to be able to slide up and down. A peripheral flange portion 216 protruding radially outward is formed on an upper end portion of the movable plunger 215 protruding upward from the upper magnetic yoke 210.

Also, the movable plunger 215 is covered with a cap 230 made of a non-magnetic body and formed in a bottomed cylindrical shape, and a flange portion 231 formed at the open end of the cap 230 so as to extend radially outward is seal joined to the lower surface of the upper magnetic yoke 210.

By so doing, a hermetic receptacle, wherein the contact housing case 102 and cap 230 are in communication via the through hole 210*a* of the upper magnetic yoke 210, is formed. Further, an arc extinguishing gas, such as a hydrogen gas, a nitrogen gas, a mixed gas of hydrogen and nitrogen, air, or $SF_6$, is enclosed in the hermetic receptacle formed by the contact housing case 102 and cap 230.

Also, a permanent magnet 220 formed in an annular shape is fixed to the upper surface of the upper magnetic yoke 210 so as to enclose the peripheral flange portion 216 of the movable plunger 215. The permanent magnet 220 is magnetized in an up-down direction, that is, in a thickness direction, so that the upper end side is an N-pole while the lower end side is an S-pole.

Further, an auxiliary yoke 225 of an external shape the same as that of the permanent magnet 220, having a through hole 224 with an inner diameter smaller than the outer diameter of the peripheral flange portion 216 of the movable plunger 215, is fixed to the upper end face of the permanent magnet 220. The peripheral flange portion 216 of the movable plunger 215 abuts the lower surface of the auxiliary yoke 225.

The shape of the permanent magnet 220, not being limited to the heretofore described shape, can also be formed in an annular shape, in other words, the external shape can be any shape as long as the inner peripheral surface is a cylindrical surface.

Also, the connecting shaft 131 which supports the movable contact 130 is screwed in the upper end face of the movable plunger 215.

Further, in the released condition, the movable plunger 215 is urged upward by the return spring 214, and is in a released position in which the upper surface of the peripheral flange portion 216 abuts against the lower surface of the auxiliary yoke 225. In this condition, the contact portions 130*a* of the movable contact 130 move upward away from the contact portions 117*a* of the fixed contacts 111 and 112, thus secured in a condition in which the current is interrupted.

In this released condition, a condition is secured in which the peripheral flange portion 216 of the movable plunger 215 is attracted to the auxiliary yoke 225 by the magnetic force of the permanent magnet 220, and in combination with the urging force of the return spring 214, the movable plunger 215 abuts the auxiliary yoke 225 without moving downward unexpectedly due to external vibration or the like.

Next, a description will be given of an operation of the second embodiment.

For now, it is assumed that an external connection terminal plate 151 is connected to, for example, a power supply source which supplies a large current, while an external connection terminal plate 152 is connected to a load.

In this condition, it is assumed that the exciting coil 208 in the electromagnet unit 200 is in a non-energized state, wherein a released condition is attained in which no exciting force causing the movable plunger 215 to descend is being generated in the electromagnet unit 200. In this released condition, the movable plunger 215 is urged in an upward direction away from the upper magnetic yoke 210 by the return spring 214. Simultaneously with this, a magnetic attractive force caused by the magnetic force of the permanent magnet 220 acts on the auxiliary yoke 225, to which the peripheral flange portion 216 of the movable plunger 215 is attracted. Because of this, the upper surface of the peripheral flange portion 216 of the movable plunger 215 abuts against the lower surface of the auxiliary yoke 225.

Because of this, the contact portions 130*a* of the contact mechanism 101 movable contact 130 connected to the movable plunger 215 via the connecting shaft 131 are separated by a predetermined distance upward from the contact portions 117*a* of the fixed contacts 111 and 112. In this condition, the current path between the fixed contacts 111 and 112 is in an interrupted condition, and the contact mechanism 101 is in an open condition.

In this way, as the urging force of the return spring 214 and the magnetic attractive force of the annular permanent magnet 220 both act on the movable plunger 215 in the released condition, it does not happen that the movable plunger 215 descends unexpectedly due to external vibration, and it is thus possible to reliably prevent malfunction.

On the exciting coil 208 of the electromagnet unit 200 being energized in the released condition, an exciting force is generated in the electromagnet unit 200, and the movable plunger 215 is pressed downward against the urging force of the return spring 214 and the magnetic attractive force of the annular permanent magnet 220.

At this time, the movable plunger 215 descends promptly against the urging force of the return spring 214 and the magnetic attractive force of the annular permanent magnet 220. By so doing, the descent of the movable plunger 215 is stopped by the lower surface of the peripheral flange portion 216 abutting against the upper surface of the upper magnetic yoke 210.

By the movable plunger 215 descending in this way, the movable contact 130 connected to the movable plunger 215 via the connecting shaft 131 also descends, and the contact portions 130*a* of the movable contact 130 contact the contact portions 117*a* of the fixed contacts 111 and 112 due to the contact pressure of the contact spring 134.

Because of this, a closed condition wherein a large current i of the external power supply source is supplied via the external connection terminal 121, fixed contact 111, movable contact 130, and fixed contact 112, and external connection terminal 121 to the load, is attained.

At this time, electromagnetic repulsion forces are generated between the fixed contacts 111 and 112 and the movable contact 130 in a direction to open the movable contact 130.

However, as each fixed contact 111 and 112 is such that a C-shaped portion 122 thereof is formed of the fixed conductor portion 120, outer side conductor plate portion 118, and inner side conductor plate portion 117, as shown in FIG. 3, the current in the fixed conductor portion 120 and the current in the inner side conductor plate portion 117 and the movable contact 130 contacting therewith flow in opposite directions. Because of this, from the relationship between magnetic fields formed by the fixed conductor portions 120 of the fixed contacts 111 and 112 and the current flowing through the movable contact 130, it is possible, in accordance with Fleming's left-hand rule, to generate greater Lorentz forces which press the movable contact 130 against the contact portions 117*a* of the fixed contacts 111 and 112, compared with when the fixed contacts 111 and 112 are formed in the L-shape as in the first embodiment.

Due to the Lorentz forces, it is possible to oppose the electromagnetic repulsion forces generated in the opening direction between the contact portions 117*a* of the fixed contacts 111 and 112 and the contact portions 130*a* of the movable contact 130, and thus possible to reliably prevent the contact portions 130*a* of the movable contact 130 from opening. Because of this, it is possible to reduce the pressing force of the contact spring 134 supporting the movable contact 130, as a result of which it is also possible to reduce thrust generated in the exciting coil 208, and it is thus possible to reduce the size of the overall configuration of the electromagnetic contactor.

At this time, the outer side conductor plate portions 118 and fixed conductor portions 120, as they are formed on the outer side of the contact housing case 102, are insulated from the movable contact 130 by the contact housing case 102. Because of this, as no conductor plate portion exists in a direction in which the movable contact 130 moves away from the inner side conductor plate portions 117 of the fixed contacts 112, arcs generated when the current is interrupted are generated only between the inner side conductor plate portions 117 of the fixed contacts 112 and the movable contact 130, meaning that there is no need to provide an arc barrier such as an insulator cover for preventing unexpected arc generation, and it is thus possible to more simplify the configuration of the contact device 100.

When interrupting the supply of current to the load the closed condition of the contact device 100, the energization of the exciting coil 208 of the electromagnet unit 200 is stopped.

By so doing, the exciting force causing the movable plunger 215 to move downward in the electromagnet unit 200 stops, as a result of which the movable plunger 215 is raised by the urging force of the return spring 214, and the magnetic attractive force of the annular permanent magnet 220 increases as the peripheral flange portion 216 nears the auxiliary yoke 225.

By the movable plunger 215 rising, the movable contact 130 connected via the connecting shaft 131 rises. As a result of this, the movable contact 130 is contacting the fixed contacts 111 and 112 for as long as contact pressure is applied by the contact spring 134. Subsequently, a start-to-open condition wherein the movable contact 130 moves upward away from the fixed contacts 111 and 112 is attained at the point at which the contact pressure of the contact spring 134 stops.

On the start-to-open condition being attained, arcs are generated between the contact portions 117*a* of the fixed contacts 111 and 112 and the contact portions 130*a* of the movable contact 130, and the condition in which current is conducted is continued due to the arcs. At this time, as the outer side conductor plate portions 118 and fixed conductor portions 120 of the fixed contacts 111 and 112 are on the outer side of the contact housing case 102, it is possible to cause the arcs to be generated only between the contact portions 117*a* of the fixed contacts 111 and 112 and the contact portions 130*a* of the movable contact 130. Because of this, it is possible to stabilize the arc generation condition, and thus possible to improve arc extinguishing performance.

At this time, as the opposing magnetic pole faces of the arc extinguishing permanent magnets 143 and 144 are N-poles, and the outer sides thereof are S-poles, the magnetic flux emanating from the N-pole of each arc extinguishing permanent magnet 143 and 144 crosses an arc generation portion of a portion in which are opposed the contact portion 117*a* of the fixed contact 111 and the contact portion 130*a* of the movable contact 130, from the inner side to the outer side in a longitudinal direction of the movable contact 130, and reaches the S-pole, whereby a magnetic field is formed. In the same way, the magnetic flux crosses an arc generation portion of the contact portion 117*a* of the fixed contact 112 and the contact portion 130*a* of the movable contact 130, from the inner side to the outer side in the longitudinal direction of the movable contact 130, and reaches the S-pole, whereby a magnetic field is formed.

Consequently, the magnetic fluxes of the arc extinguishing magnets 143 and 144 both cross between the contact portion 117*a* of the fixed contact 111 and the contact portion 130*a* of the movable contact 130 and between the contact portion 117*a* of the fixed contact 112 and the contact portion 130*a* of the movable contact 130, in mutually opposite directions in the longitudinal direction of the movable contact 130.

Because of this, a current I flows from the fixed contact 111 side to the movable contact 130 side between the contact portion 117*a* of the fixed contact 111 and the contact portion 130*a* of the movable contact 130, and the orientation of the magnetic fluxes $\phi$ is in a direction from the inner side toward the outer side. Because of this, in accordance with Fleming's left-hand rule, large Lorentz forces act toward the arc extinguishing space 145 side, perpendicular to the longitudinal direction of the movable contact 130 and perpendicular to the opening/closing direction of the contact portion 117*a* of the fixed contact 111 and the movable contact 130.

Due to the Lorentz force, an arc generated between the contact portion 117*a* of the fixed contact. 111 and the contact portion 130*a* of the movable contact 130 is greatly extended so as to pass from the side surface of the contact portion 117*a* of the fixed contact 111 through inside the arc extinguishing space 145, reaching the upper surface side of the movable contact 130, and is extinguished.

Also, at the lower side and upper side of the arc extinguishing space 145, a magnetic flux inclines to the lower side and upper side with respect to the orientation of the magnetic flux between the contact portion 117*a* of the fixed contact 111 and the contact portion 130*a* of the movable contact 130. Because of this, the arc extended to the arc extinguishing space 145 is further extended by the inclined magnetic flux in the direction of the corner of the arc extinguishing space 145, and it is possible to increase the arc length, and thus possible to obtain good interruption performance.

Meanwhile, the current I flows from the movable contact 130 side to the fixed contact 112 side between the contact portion 117*a* of the fixed contact 112 and the movable contact 130, and the orientation of the magnetic flux $\phi$ is in a rightward direction from the inner side toward the outer side. Because of this, in accordance with Fleming's left-hand rule, a large Lorentz force acts toward the arc extinguishing space 145 side, perpendicular to the longitudinal direction of the movable contact 130 and perpendicular to the direction in which the movable contact 130 is movable toward and away from the contact portion 117*a* of the fixed contact 112.

Due to the Lorentz force, an arc generated between the contact portion 117*a* of the fixed contact 112 and the movable contact 130 is greatly extended so as to pass from the upper surface side of the movable contact 130 through inside the arc extinguishing space 145, reaching the side surface side of the fixed contact 112, and is extinguished.

Also, at the lower side and upper side of the arc extinguishing space 145, as heretofore described, a magnetic flux inclines to the lower side and upper side with respect to the orientation of the magnetic flux between the contact portion 117*a* of the fixed contact 112 and the contact portion 130*a* of the movable contact 130. Because of this, the arc extended to the arc extinguishing space 145 is further extended by the inclined magnetic flux in the direction of the corner of the arc extinguishing space 145, and it is possible to increase the arc length, and thus possible to obtain good interruption performance.

Meanwhile, with the electromagnetic contactor 50 powered on, when adopting a released condition in a condition in which a regenerative current flows from the load side to the direct current power source side, the previously described direction of current is reversed, meaning that the Lorentz forces F act on the arc extinguishing space 146 side, and other than the arcs are extended to the arc extinguishing space 146 side, the same arc extinguishing function is fulfilled.

At this time, because the arc extinguishing permanent magnets 143 and 144 are disposed in the magnet housing cylindrical bodies 141 and 142 formed in the insulating cylindrical body 140, the arcs do not directly contact the arc extinguishing permanent magnets 143 and 144. Because of this, it is possible to stably maintain the magnetic characteristics of the arc extinguishing permanent magnets 143 and 144, and thus possible to stabilize interruption performance.

Also, as it is possible to cover and insulate the inner peripheral surface of the metal contact housing case 102 with the insulating cylindrical body 140, there is no short circuiting of the arcs when the current is interrupted, and it is thus possible to reliably carry out current interruption.

Furthermore, as it is possible to carry out the insulating function, the function of positioning the arc extinguishing permanent magnets 143 and 144, and the function of protecting the arc extinguishing permanent magnets 143 and 144 from the arcs, with the one insulating cylindrical body 140, it is possible to reduce manufacturing cost.

In this way, according to the second embodiment, as the contact device 100 is such that the outer side conductor plate portions 118 and fixed conductor portions 120, of the C-shaped portions 122 of the fixed contacts 111 and 112, are disposed outside the contact housing case 102, it is possible to reduce the height and width of the contact housing case 102 and thus reduce the size of the contact device 100.

Also, as the arc extinguishing permanent magnets 143 and 144 are disposed on the inner peripheral surfaces, of the insulating cylindrical body 140 configuring the contact housing case 102, opposite to the side edges of the movable contact 130, it is possible to bring the arc extinguishing permanent magnets 143 and 144 near to the contact faces of the pair of fixed contacts 111 and 112 and the movable contact 130. Consequently, it is possible to increase the density of magnetic fluxes from the inner side toward the outer side in an extension direction of the movable contact 130, meaning that it is possible to reduce the magnetic force of the arc extinguishing permanent magnets 143 and 144 for obtaining a necessary magnetic flux density, and thus possible to carry out a reduction in cost of the arc extinguishing permanent magnets.

Also, as it is possible to increase the distance between the side edges of the movable contact 130 and their respective inner peripheral surfaces of the insulating cylindrical body 140 by an amount equivalent to the thickness of the arc extinguishing permanent magnets 143 and 144, it is possible to provide the sufficiently large arc extinguishing spaces 145 and 146, and thus possible to reliably carry out the extinguishing of the arcs.

Furthermore, as the movable contact guide members 148 and 149 slide contacting the side edges of the movable contact are formed protruding in positions, on the permanent magnet housing cylindrical bodies 141 and 142 housing the arc extinguishing permanent magnets 143 and 144, facing the movable contact 130, it is possible to reliably prevent turning of the movable contact 130.

In the heretofore described embodiments, a description has been given of a case in which the contact device CD according to the invention is applied to the electromagnetic contactor, but the invention not being limited to this, the contact device CD can be applied to any device such as a switch or a direct current relay.

INDUSTRIAL APPLICABILITY

According to the invention, it is possible to provide a contact device with which it is possible to suppress electromagnetic repulsion forces which cause a movable contact to open when current is conducted without increasing the size of the overall configuration, and an electromagnetic contactor using the contact: device.

REFERENCE SIGNS LIST

1 . . . Main body case, 1*a* . . . Upper case, 1*b* . . . Lower case, CD . . . Contact device, 2 . . . Fixed contact, 2*a*, 2*b* . . . Fixed contact portion, 2*c*, 2*d* . . . Inner side conductor plate portion, 2*e*, 2*f* . . . Outer side conductor plate portion, 2*g*, 2*h* . . . L-shaped conductor plate portion, 2*i*, 2*j* . . . Fixed conductor plate portion, 2*m*, 2*n* . . . External connection terminal, 3 . . . Movable contact, 3*a* . . . Conductive plate portion, 3*b*, 3*c* . . . Movable contact portion, 4 . . . Operating electromagnet, 5 . . . Fixed iron core, 6 . . . Movable iron core, 8 . . . Electromagnetic coil, 9 . . . Return spring, 11 . . . Contact holder, 12 . . . Contact spring, 13 . . . Stopper, 50 . . . Electromagnetic contactor, 100 . . . Contact device, 101 . . . Contact mechanism, 102 . . . Contact housing case, 102*a* . . . Rectangular cylindrical portion, 102*b* . . . Top plate portion, 111, 112 . . . Fixed contact, 117 . . . Inner side conductor plate portion, 118 . . . Outer side conductor plate portion, 119 . . . L-shaped conductor portion, 120 . . . Fixed conductor portion, 121 . . . External connection terminal, 122 . . . C-shaped portion, 130 . . . Movable contact, 130*a* . . . Contact portion, 131 . . . Connecting shaft, 132 . . . Depressed portion, 134 . . . Contact spring, 135 . . . C-ring, 140 . . . Insulating cylindrical body, 141, 142 . . . Magnet housing cylindrical body, 143, 144 . . . Arc extinguishing permanent magnet, 145, 146 . . . Arc extinguishing space, 200 . . . Electromagnet unit, 201 . . . Magnetic yoke, 202 . . . Bottom plate portion, 203 . . . Cylindrical auxiliary yoke, 204 . . . Spool, 208 . . . Exciting coil, 210 . . . Upper magnetic yoke, 210*a* . . . Through hole, 214 . . . Return spring, 215 . . . Movable plunger, 216 . . . Peripheral flange portion, 220 . . . Permanent magnet, 225 . . . Auxiliary yoke, 230 . . . Cap

What is claimed is:

1. A contact device comprising:

a contact mechanism including a pair of fixed contacts disposed to maintain a predetermined distance and a movable contact disposed contacting to and separating from the pair of fixed contacts; and a contact housing case housing the contact mechanism, and having an upper case having an inner portion and an outer portion disposed outside of the inner portion, wherein the movable contact has a conductive plate portion extending in a direction crossing a moving direction of the movable contact in the contact housing case, each of the pair of fixed contacts includes an inner side conductor plate portion having one end facing one end portion of the conductive plate portion of the movable contact and another end portion extending toward an outside of the contact housing case in parallel to the conductive plate portion, an outer side conductor plate portion having one end portion connected to the another end portion of the inner side conductor plate portion and at least extending in a direction separating from the movable contact, the inner and outer side conductor plate portions forming an L-shaped conductor portion to generate a Lorentz force opposing an electromagnetic repulsion force generated in an opening direction between the fixed contact and the movable contact when current is conducted, and an external connection terminal connected to another end portion of the outer side conductor plate portion and extending outwardly in parallel to the inner side conductor plate portions, and each of the pair of outer side conductor plate portions is arranged between the inner portion and the outer portion; and each of the pair of external connection terminals extends outwardly from the inner portion and is arranged in the outer portion.

2. The contact device according to claim 1, wherein the outer portion includes bolts disposed on the outer portion.

* * * * *